US005899182A

United States Patent [19]

Martinsson et al.

[11] Patent Number: 5,899,182

[45] Date of Patent: May 4, 1999

[54] DEVICE FOR ATTACHING AN ENGINE COVER

[75] Inventors: Pär Martinsson, Jönköping; Jan Leijon, Norrahammar; Hasse Lilja, Jönköping, all of Sweden

[73] Assignee: Aktiebolaget Electrolux, Stockholm, Sweden

[21] Appl. No.: 08/958,303

[22] Filed: Oct. 27, 1997

[30] Foreign Application Priority Data

Nov. 27, 1996 [SE] Sweden ..... 9604362

[51] Int. Cl.[6] ..... F01M 9/10

[52] U.S. Cl. ..... 123/90.38; 123/195 C; 123/198 E

[58] Field of Search ..... 123/90.38, 195 C, 123/198 E

[56] References Cited

U.S. PATENT DOCUMENTS 4,788,950 12/1988 Finley ..... 123/90.38

5,311,847 5/1994 Boehning ..... 123/90.38

FOREIGN PATENT DOCUMENTS 42 09 476 9/1993 Germany .

616 440 7/1978 U.S.S.R. .

*Primary Examiner*—Weilun Lo

*Attorney, Agent, or Firm*—Pearne, Gordon, McCoy & Granger LLP

[57] ABSTRACT

A device for releasably attaching a cover (11) to an engine housing (10) of a power-driven tool, such as a motor saw. The device includes at least one spring clip (12) which is adapted to be releasably connected to one of the engine housing and the cover. A guide pin (15) is attached to the engine housing or the cover adjacent to the spring clip and adapted to engage in a complementary recess (16) in the cover or the engine housing. A supporting plate (17); made of a hard material, is attached to the engine housing or the cover around the guide pin.

10 Claims, 2 Drawing Sheets

DEVICE FOR ATTACHING AN ENGINE COVER

BACKGROUND OF THE INVENTION

The present invention relates to an attachment device, especially for releasably attaching a cover to an engine housing of a power-driven tool such as a motor saw, comprising at least one spring clip adapted to be releasably connected to the engine housing and/or the cover, and a guide pin attached to the engine housing or the cover adjacent to the spring clip and adapted to engage in a complementary recess in the cover or engine housing.

For attaching a cylinder cover to a motor chain saw, for example, it is preferable to use spring clips that can easily and quickly be clamped and released, to facilitates the attachment and removal of the cover. In chain saws and similar tools having an internal combustion engine, however, secure attachment of the cover encounters problems caused by engine vibrations. Such vibrations result in mutual movement of the interengaging surfaces of the cover and the engine housing. For example, when a cover of glass-fibre reinforced plastic abuts an engine housing of a light metal, such as magnesium, such mutual movement will result in wear of the interengaging surfaces, primarily on the engine housing. Similar wear problems may occur even in the case of other combinations of material, such as when both the interengaging surfaces are made of reinforced plastic, or metal.

A SUMMARY OF THE INVENTION

The object of the present invention is to provide an attachment device that eliminates the above-mentioned problem and enables the use of spring clips without causing wear damage to the cover or engine housing. This has been achieved by means of an attachment device wherein a supporting plate, made of a hard material, is attached to the engine housing or the cover around said guide pin. The spring clip, guide pin and supporting plate are generally aligned with each other in a common plane.

BRIEF DESCRIPTION OF THE DRAWINGS

A preferred embodiment of the invention will be described in more detail in the following with reference to the accompanying drawing, wherein.

DESCRIPTION OF THE PREFERRED EMBODIMENT

Figure 1:
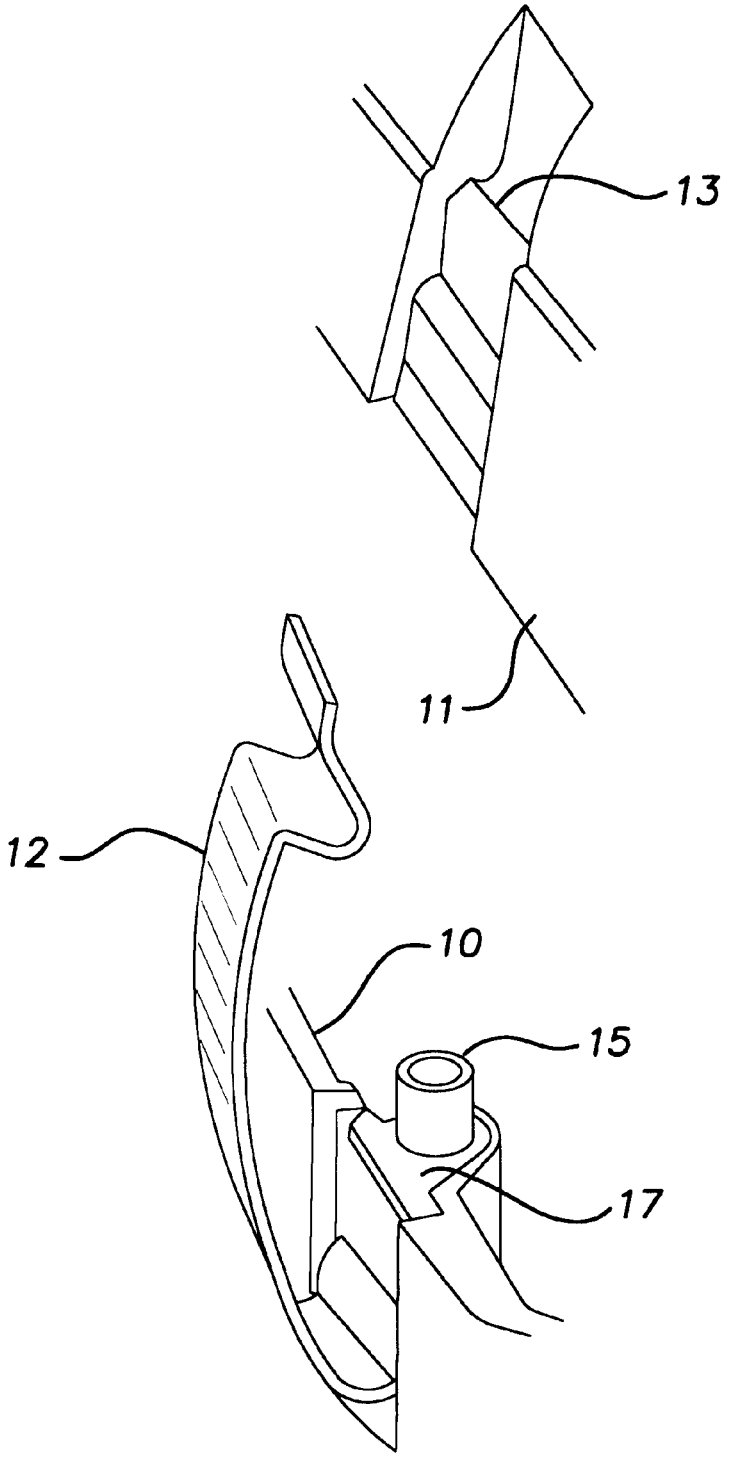
FIG. 1 illustrates a partial exploded perspective view of a cover and an engine housing provided with the device according to the invention in a released position.

With reference to the drawings, a portion of an engine housing 10 is shown which is, for instance, a crankcase of a two-stroke engine. The engine housing 10 is preferably made of a light metal, such as magnesium, and is provided with a cylinder cover 11 which is preferably made of glass-fibre reinforced plastic. The cylinder cover 11 is clamped to the engine housing 10 by means of a plurality of spring clips 12, one of which is illustrated in the drawing. A lower end of the spring clip 12 is pivoted to the engine housing 10 and an upper end thereof cooperates with a step 13 on the cover 11 to releasably secure the cover 11 to the housing 10.

Figure 2:
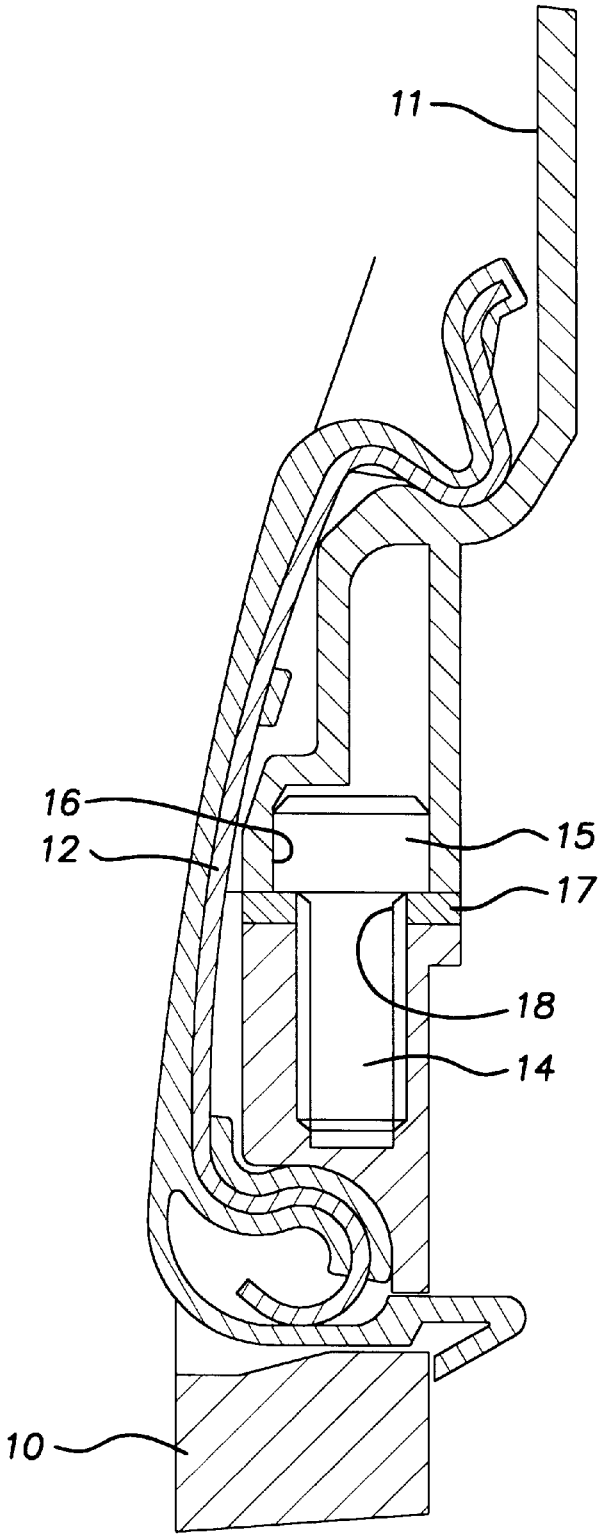
FIG. 2 is a section shown on a larger scale of the device shown in FIG. 1 in a clamped position.

In order to fix the cover 11 in its correct position and prevent mutual movement of the cover and the engine housing, a screw 14 is attached to the engine housing. A head of the screw 14 forms a guide pin 15 cooperating with a complementary recess 16 in the cover 11, as is shown in FIG. 2. Due to engine vibrations it has proved to be difficult, even with a close fit between the guide pin 15 and the recess 16, to completely prevent mutual movements of the cover and the engine housing 10, due to small rotational movements occurring around the guide pin. In order to prevent such movements from resulting in wear of the interengaging surfaces of the engine housing 10 and the cover 11, the engine housing 10 is provided with a supporting plate 17 of a hard material, such as stainless steel. The supporting plate 17 is attached to the engine housing 10 by means of the screw 14 and, to this end is provided with a bore 18 through which the screw is inserted. As is best shown in FIG. 2, the supporting plate 17 has a supporting surface situated around the guide pin 15 and carrying thrust forces created by the spring clip 12. In order to provide the best function in this respect, the spring, clip 12 the guide pin 15 and the supporting plate 17 should preferably be aligned with each other in a common plane.

Since the supporting plate is made of a hard material resistant to wear, possible movements occurring between the cover 11 and the engine housing 12 will not result in any noticeable wear of the interengaging surfaces.

It is also within the framework of the invention to attach the guide pin 15 and the supporting plate 17 to the cover 11 and to provide the recess 16 in the engine housing. According to the invention it is also possible to make the guide pin 15 integral with the supporting plate 17.

What is claimed is:

1. Attached device for releasably attaching a cover (11) to an engine housing (10) of a power-driven tool, said device comprising at least one spring clip (12) adapted to be releasably connected to one of said engine housing and said cover, a guide pin (15) attached to said engine housing adjacent to said spring clip and adapted to engage in a complementary recess (16) in said cover, wherein a supporting plate (17) made of a hard material is attached to said engine housing around said guide pin, said spring clip (12), said guide pin (15) and said supporting plate (17) being generally aligned with each other in a common plane.

2. Device according to claim 1 wherein the guide pin (15) comprises the head of a screw (14), said screw serving to secure the supporting plate (17) to the engine housing (10).

3. Device according to any of claims 1–2, wherein the supporting plate (17) is made of stainless steel.

4. Device according to any of claims 1–2, wherein the guide pin (15) is made integrally with the supporting plate (17).

5. Device according to claim 3, wherein the guide pin (15) is made integrally with the supporting plate (17).

6. An attachment device for releasably attaching a cover (11) to an engine housing (10) of a power-driven tool, said device comprising at least one spring clip (12) adapted to be releasably connected to one of said engine housing and said cover, a guide pin (15) attached to said cover adjacent to said spring clip and adapted to engage in a complementary recess in said engine housing, wherein a supporting plate (17) made of a hard material is attached to said cover around said guide pin, said spring clip (12), said guide pin (15) and said supporting plate (17) being generally aligned with each other in a common plane.

7. Device according to claim 6, wherein the guide pin (15) comprises the head of a screw (14), said screw serving to secure the supporting plate (17) to the cover.

8. Device according to any of claims 6–7, wherein the supporting plate (17) is made of stainless steel.

9. Device according to any of claims 6–7, wherein the guide pin (15) is made integrally with the supporting plate (17).

10. Device according to claim 8, wherein the guide pin (15) is made integrally with the supporting plate (17).

* * * * *

UNITED STATES PATENT AND TRADEMARK OFFICE

CERTIFICATE OF CORRECTION

PATENT NO. : 5,899,182
DATED : May 4, 1999
INVENTOR(S) : Martinsson et al.

It is certified that error appears in the above-identified patent and that said Letters Patent is hereby corrected as shown below:

Column 1, Line 37, delete "said" and insert --the--.

Column 2, Line 6, after "cover" insert --11--.

Column 2, Line 14, after "end" insert --,-- (comma).

Column 2, Line 19, after "spring" delete --,-- (comma).

Column 2, Line 19, after "clip 12" insert --,-- (comma).

Signed and Sealed this

Twenty-first Day of September, 1999

*Attest:*

Q. TODD DICKINSON

*Attesting Officer*

*Acting Commissioner of Patents and Trademarks*